US008749331B2

(12) United States Patent
Kashimura et al.

(10) Patent No.: US 8,749,331 B2
(45) Date of Patent: Jun. 10, 2014

(54) ELECTROMAGNETIC CONTACTOR

(75) Inventors: Osamu Kashimura, Hino (JP); Masaru Isozaki, Ichihara (JP); Hiroyuki Tachikawa, Yokohama (JP); Kouetsu Takaya, Kounosu (JP); Yasuhiro Naka, Kounosu (JP); Yuji Shiba, Kounosu (JP)

(73) Assignees: Fuji Electric Co., Ltd., Kawasaki-shi (JP); Fuji Electric FA Components & Systems Co., Ltd., Tokyo (JP)

( * ) Notice: Subject to any disclaimer, the term of this patent is extended or adjusted under 35 U.S.C. 154(b) by 0 days.

(21) Appl. No.: 13/878,933

(22) PCT Filed: May 9, 2012

(86) PCT No.: PCT/JP2012/003043

§ 371 (c)(1),
(2), (4) Date: May 7, 2013

(87) PCT Pub. No.: WO2012/157218

PCT Pub. Date: Nov. 22, 2012

(65) Prior Publication Data

US 2013/0228552 A1 Sep. 5, 2013

(30) Foreign Application Priority Data

May 19, 2011 (JP) ..... 2011-112916

(51) Int. Cl.
*H01H 9/30* (2006.01)
*H01H 67/02* (2006.01)

(52) U.S. Cl.
USPC ..... 335/201; 335/126

(58) Field of Classification Search
USPC ..... 335/201, 126
See application file for complete search history.

(56) References Cited

U.S. PATENT DOCUMENTS

| | | | | |
|---|---|---|---|---|
| 5,546,061 | A * | 8/1996 | Okabayashi et al. | 335/78 |
| 7,157,996 | B2 * | 1/2007 | Enomoto et al. | 335/132 |
| 7,852,178 | B2 * | 12/2010 | Bush et al. | 335/126 |
| 7,859,373 | B2 * | 12/2010 | Yamamoto et al. | 335/126 |
| 8,179,217 | B2 * | 5/2012 | Kawaguchi et al. | 335/80 |
| 8,188,818 | B2 * | 5/2012 | Cho et al. | 335/126 |
| 8,222,980 | B2 * | 7/2012 | Yamagata et al. | 335/126 |
| 8,390,410 | B2 * | 3/2013 | Kojima et al. | 335/201 |
| 2005/0151606 | A1 | 7/2005 | Nishida et al. | |
| 2010/0060392 | A1 * | 3/2010 | Cho et al. | 335/124 |
| 2010/0289604 | A1 * | 11/2010 | Kojima et al. | 335/133 |

FOREIGN PATENT DOCUMENTS

| | | | |
|---|---|---|---|
| JP | S57-170252 | U | 10/1982 |
| JP | H09-259728 | A | 10/1997 |
| JP | 2011-204478 | A | 10/2011 |

* cited by examiner

*Primary Examiner* — Alexander Talpalatski
(74) *Attorney, Agent, or Firm* — Manabu Kanesaka

(57) ABSTRACT

An electromagnetic contactor has a contact device having a contact housing case housing a pair of fixed contacts and a movable contact disposed to be capable of contacting to and separating from the pair of fixed contacts, and an insulating cylinder in a bottomed tubular shape disposed on an inner peripheral surface of the contact housing case to enclose the pair of fixed contacts and the movable contact. The insulating cylinder positions an arc extinguishing permanent magnet for extinguishing an arc generated between the pair of fixed contacts and the movable contact. A magnet housing portion to protect the arc extinguishing permanent magnet from the arc is formed on an inner peripheral surface of the insulating cylinder and faces a side surface of the movable contact. An arc extinguishing space is formed on an outer side of the magnet housing portion in an extending direction of the movable contact.

7 Claims, 10 Drawing Sheets

ELECTROMAGNETIC CONTACTOR

RELATED APPLICATIONS

The present application is National Phase of International Application No. PCT/JP2012/003043 filed May 9, 2012, and claims priority from Japanese Application No. 2011-112916, filed May 19, 2011.

TECHNICAL FIELD

The present invention relates to an electromagnetic contactor wherein fixed contacts and a movable contact are disposed in a contact housing case.

BACKGROUND ART

For an electromagnetic contactor that carries out switching of a current path, a movable contact is driven by an exciting coil and movable plunger of an electromagnet unit. That is, when the exciting coil is in a non-excited state, the movable plunger is urged by a return spring, and the movable contact is in a released condition wherein the movable contact is distanced from a pair of fixed contacts disposed maintaining a predetermined interval. From the released condition, the movable plunger can be moved against the return spring by exciting the exciting coil, and the movable contact contacts the pair of fixed contacts and becomes an engaged condition (for example, refer to PTL 1).

The heretofore known example described in PTL 1 is such that a pair of fixed contacts and a movable contact are disposed in a hermetic receptacle formed of a heat-resistant material such as a ceramic with one face opened in box-form. Also, in order to extinguish an arc generated between the fixed contacts and movable contact when changing from an engaged condition to a released condition, a permanent magnet and magnetic means formed of a magnetic member sandwiching the permanent magnet are attached to the outer surface of the hermetic receptacle so that the magnetic member sandwiches the fixed contacts and movable contact. A magnetic field perpendicular to the direction of operation of the movable contact is provided by the magnetic means to a space in which the fixed contacts and movable contact exist.

CITATION LIST

Patent Literature

PTL 1: Japanese Patent No. 3,107,288

SUMMARY OF INVENTION

Technical Problem

However, with the heretofore known example described in PTL 1, there is an unsolved problem in that, because the magnetic means that forms a magnetic field for extinguishing an arc is disposed on the outer side of the hermetic receptacle, increasing the flux density of the magnetic field generated by the magnetic means is not possible, the usage of a highly magnetic permanent magnet is necessary, and the manufacturing cost is soar. Also, although it is feasible, in order to use a low-priced permanent magnet with low magnetism, that the magnetic means is such that the permanent magnet is disposed inside the hermetic receptacle, there is an unsolved problem in this case in that it can be supposed that the magnetic properties will deteriorate due to the permanent magnet being exposed to the arc, protective means is necessary, and the overall configuration becomes large and complex.

Furthermore, there is also an unsolved problem in that, because the magnetic means is disposed on the outer side of the hermetic receptacle, separate positioning means for magnetic means are necessary, and assemblability deteriorates.

Therefore, the invention, conceiving the unsolved problems of the heretofore known example, has an object of providing an electromagnetic contactor including a function of positioning a permanent magnet for arc extinguishing, a function of protecting from an arc, and necessary insulating functions, thereby enabling a reduction in size while ensuring a sufficient arc extinguishing function.

Solution to Problem

In order to achieve the heretofore described object, an electromagnetic contactor according to one aspect of the invention includes a contact device having a contact housing case housing a pair of fixed contacts and a movable contact disposed to be capable of contacting to and separating from the pair of fixed contacts. The electromagnetic contactor has an insulating cylinder in a bottomed tubular shape disposed on an inner peripheral surface of the contact housing case to enclose the pair of fixed contacts and the movable contact. The insulating cylinder positions an arc extinguishing permanent magnet for extinguishing an arc generated between the pair of fixed contacts and the movable contact. A magnet housing portion to protect the arc extinguishing permanent magnet from the arc is formed on the inner peripheral surface of the insulating cylinder and faces a side surface of the movable contact. An arc extinguishing space is formed on an outer side of the magnet housing portion in an extending direction of the movable contact.

According to this configuration, it is possible to position the arc extinguishing permanent magnet that extinguishes the arc in the magnet housing portion, and to prevent the arc from directly contacting with the arc extinguishing permanent magnet, and it is possible to enclose the arc, thus preventing it from affecting an external metal member. Furthermore, it is possible to widen the arc extinguishing space, and thus possible to reliably extinguish the arc.

Also, the electromagnetic contactor according to another aspect of the invention is such that the insulating cylinder in the bottomed tubular shape is integrally formed.

According to this configuration, as the insulating cylinder in the bottomed tubular shape is configured by integral molding, it is possible to easily form an insulating cylinder of bottomed tubular form that has a magnet housing portion.

Also, the electromagnetic contactor according to another aspect of the invention is such that the insulating cylinder includes an insulating base member formed with a magnet housing portion of a base portion, and an insulating cylinder mounted on an upper surface of the insulating base member.

According to this configuration, as the insulating cylinder in the bottomed tubular shape is formed in two portions, those being the insulating base member and insulating cylinder, it is possible to easily carry out the installation of the pair of fixed contacts and movable contact.

Also, the electromagnetic contactor according to another aspect of the invention is such that the insulating cylinder includes an insulating base member formed with a magnet housing portion of a base portion, and an insulating cylinder mounted on the upper surface of the insulating base member.

According to this configuration, as the insulating cylinder is divided into the insulating base member and insulating cylinder, it is possible to easily carry out the assembly of the pair of fixed contacts and movable contact when the assembly space thereof is small.

Also, the electromagnetic contactor according to another aspect of the invention is such that the magnet housing portion is disposed along a long side of the insulating cylinder and facing a side edge of the movable contact. The insulating cylinder includes an insulating base member in a rectangular shape viewed from a plan view, which is provided with a pair of side plate portions extending upward along short sides of the insulating base member, and a pair of connection members connecting side edges of the pair of side plate portions of the insulating base member along the outer side of the magnet housing portion.

According to this configuration, when the assembly space of the pair of fixed contacts and movable contact is small, it is possible to carry out the assembly of the pair of fixed contacts and movable contact in a condition wherein a pair of connection members is removed, and thus possible to easily carry out the assembly.

Advantageous Effects of Invention

According to the invention, because there is provided an insulating cylinder in a bottomed tubular shape that encloses the pair of fixed contacts and the movable contact to be capable of contacting to and separating from the pair of fixed contacts, it is possible, with the insulating cylinder, to provide a function of positioning the arc extinguishing permanent magnet, a function of protecting the permanent magnet from the arc, and an insulating function preventing the arc from affecting the external metal member, and an advantage is obtained in that it is possible to safely and reliably carry out arc extinguishing with no deviation in the position of the permanent magnet. Because it is possible to fulfill three functions with one insulating cylinder, it is possible to reduce the number of parts to a minimum, and thus possible to achieve a reduction in cost.

DESCRIPTION OF EMBODIMENTS

Hereafter, a description will be given, based on the drawings, of an embodiment of the invention.

Figure 1:
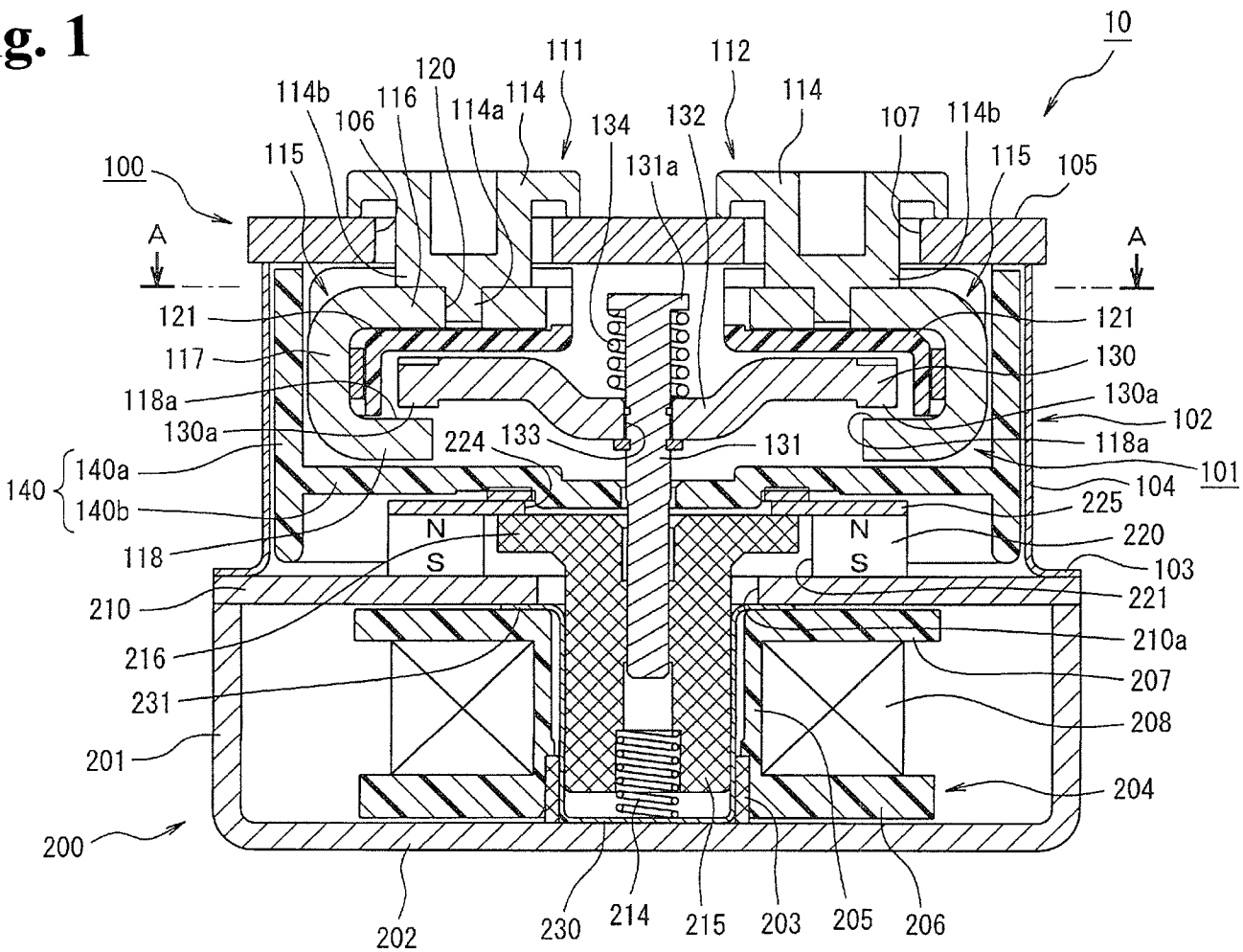
FIG. 1 is a sectional view showing a first embodiment of an electromagnetic contactor according to the invention.
Figure 2:
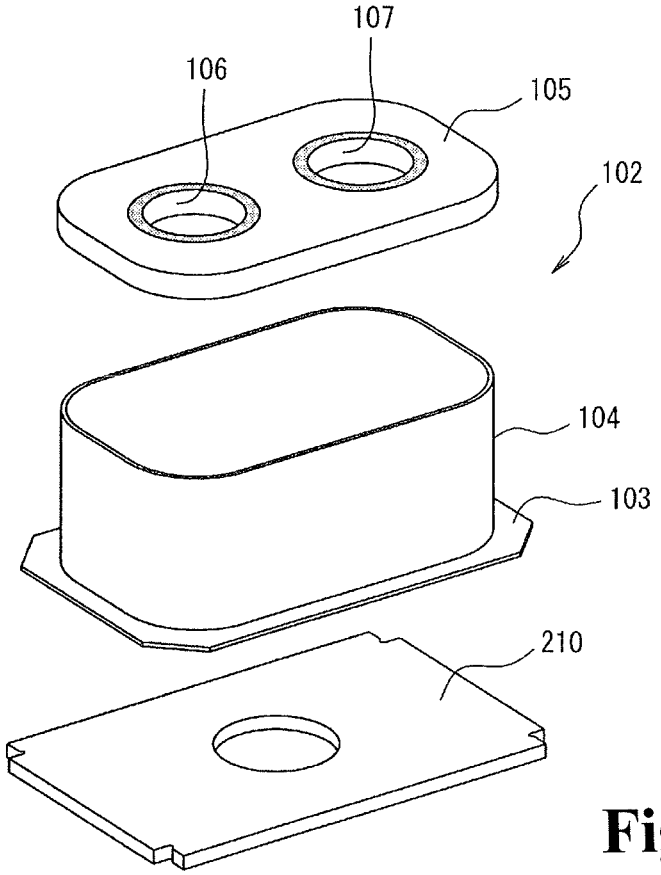
FIG. 2 is an exploded perspective view showing a contact housing case of FIG. 1.

FIG. 1 is a sectional view showing one example of an electromagnetic switch according to the invention, while FIG. 2 is an exploded perspective view of a contact housing case. In FIG. 1 and FIG. 2, numeral 10 is an electromagnetic contactor, and the electromagnetic contactor 10 is configured of a contact device 100 in which is disposed a contact mechanism, and an electromagnet unit 200 that drives the contact device 100.

As it is clear from FIG. 1 and FIG. 2, the contact device 100 has a contact housing case 102 that houses a contact mechanism 101. As shown in FIG. 2, the contact housing case 102 includes a metal tubular body 104 having on a lower end portion a metal flange portion 103 protruding outward, and a fixed contact support insulating substrate 105 configured of a plate-like ceramic insulating substrate that closes off the upper end of the metal tubular body 104.

The metal tubular body 104 is such that the flange portion 103 thereof is seal joined and fixed to an upper portion magnetic yoke 210 of the electromagnet unit 200, to be described hereafter.

Also, through holes 106 and 107 for inserting a pair of fixed contacts 111 and 112, to be described hereafter, are formed maintaining a predetermined interval in a central portion of the fixed contact support insulating substrate 105. A metalizing process is performed around the through holes 106 and 107 on the upper surface side of the fixed contact support insulating substrate 105, and in a position on the lower surface side that contacts with the metal tubular body 104. Further, the fixed contact support insulating substrate 105 is brazed to the upper surface of the metal tubular body 104.

The contact mechanism 101, as shown in FIG. 1, includes the pair of fixed contacts 111 and 112 inserted into and fixed in the through holes 106 and 107 of the fixed contact support insulating substrate 105 of the contact housing case 102. Each of the fixed contacts 111 and 112 includes a support conductor portion 114, having on an upper end a flange portion protruding outward, inserted into the through holes 106 and 107 of the fixed contact support insulating substrate 105, and a C-shaped portion 115, the inner side of which is opened, linked to the support conductor portion 114 and disposed on the lower surface side of the fixed contact support insulating substrate 105.

The C-shaped portion 115 is formed in a C-shape of an upper plate portion 116 extending to the outer side along the line of the lower surface of the fixed contact support insulating substrate 105, an intermediate plate portion 117 extending downward from the outer side end portion of the upper plate portion 116, and a lower plate portion 118 extending from the lower end side of the intermediate plate portion 117, parallel with the upper plate portion 116, to the inner side, that is, in a direction facing the fixed contacts 111 and 112, wherein the upper plate portion 116 is added to an L-shape formed by the intermediate plate portion 117 and lower plate portion 118.

Herein, the support conductor portion 114 and C-shaped portion 115 are fixed by, for example, brazing in a condition in which a pin 114*a* formed protruding on the lower end surface of the support conductor portion 114 is inserted into a through hole 120 formed in the upper plate portion 116 of the C-shaped portion 115. The fixing of the support conductor portion 114 and C-shaped portion 115, not being limited to brazing, may be such that the pin 114*a* is fitted into the through hole 120, or an external thread is formed on the pin

114*a* and an internal thread formed in the through hole 120, and the two are screwed together.

Furthermore, an insulating cover 121, made of a synthetic resin material, that regulates arc generation is mounted on the C-shaped portion 115 of each of the fixed contacts 111 and 112. The insulating cover 121 covers the inner peripheral surfaces of the upper plate portion 116 and intermediate plate portion 117 of the C-shaped portion 115, as shown in FIGS. 3(*a*) and 3(*b*).

The insulating cover 121 includes an L-shaped plate portion 122 that follows the inner peripheral surfaces of the upper plate portion 116 and intermediate plate portion 117, side plate portions 123 and 124, each extending upward and outward from front and rear end portions of the L-shaped plate portion 122, that cover side surfaces of the upper plate portion 116 and intermediate plate portion 117 of the C-shaped portion 115, and a fitting portion 125, formed on the inward side from the upper end of the side plate portions 123 and 124, that fits onto a small diameter portion 114*b* formed on the support conductor portion 114 of the fixed contacts 111 and 112.

Figure 3A:
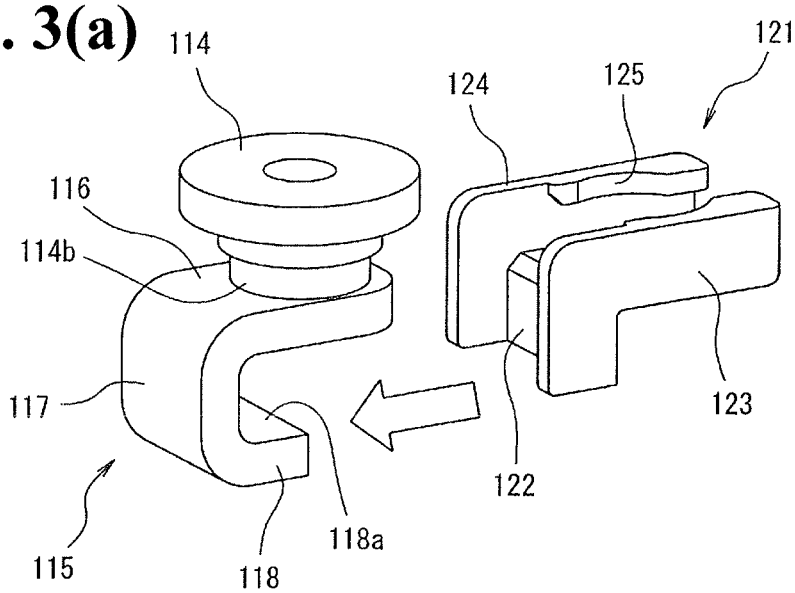
FIGS. 3(*a*)-3(*c*) are diagrams showing an insulating cover of a contact mechanism, wherein FIG. 3(*a*) is a perspective view, FIG. 3(*b*) is a plan view before mounting, and FIG. 3(*c*) is a plan view after mounting.
Figure 3B:
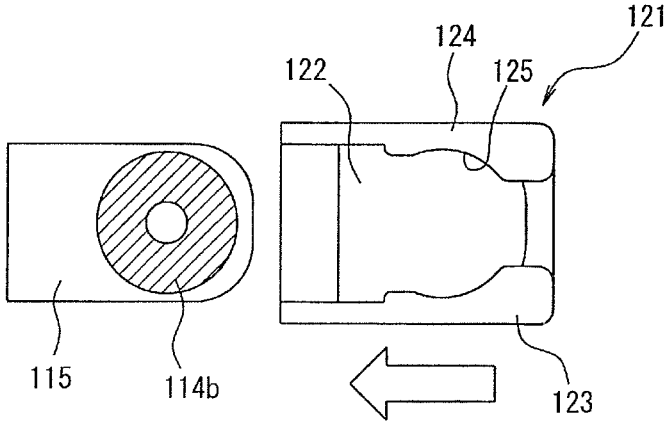
Figure 3C:
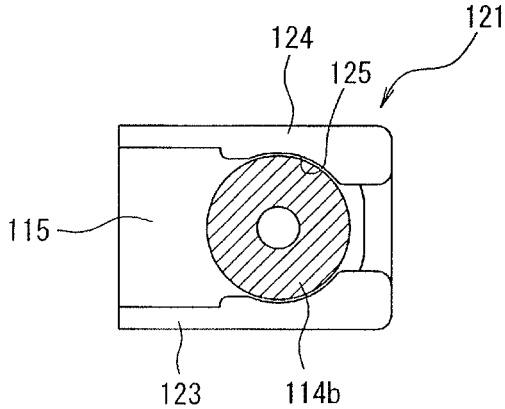

Consequently, the insulating cover 121 is placed in a condition in which the fitting portion 125 is facing the small diameter portion 114*b* of the support conductor portion 114 of the fixed contacts 111 and 112, as shown in FIGS. 3(*a*) and 3(*b*), after which, as shown in FIG. 3(*c*), the fitting portion 125 is fitted onto the small diameter portion 114*b* of the support conductor portion 114 by pushing the insulating cover 121.

Figure 4A:
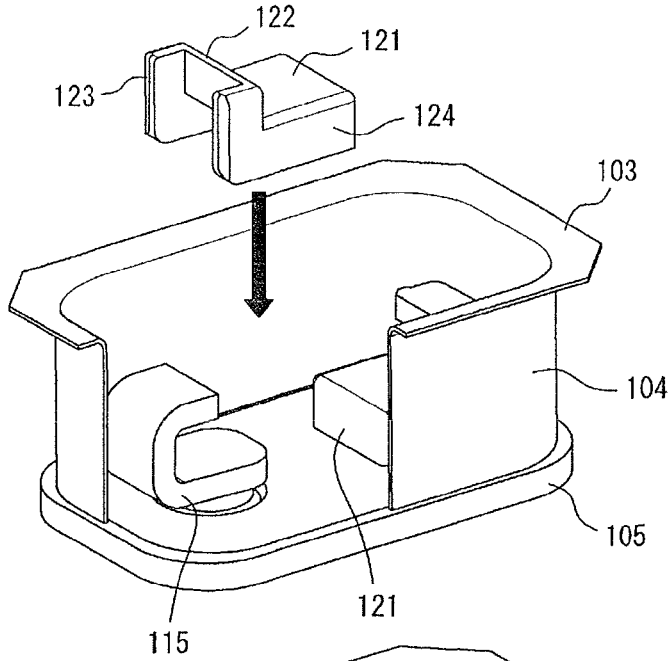
FIG. 4 is a perspective view showing an insulating cover mounting method.
Figure 4B:
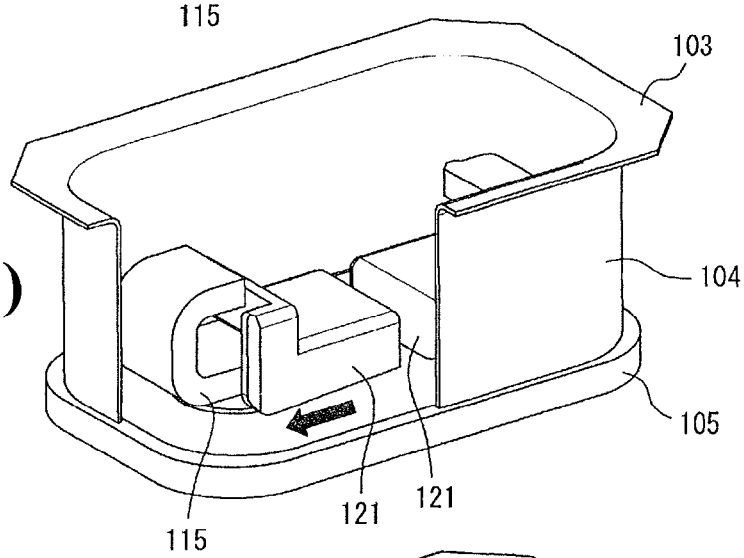
Figure 4C:
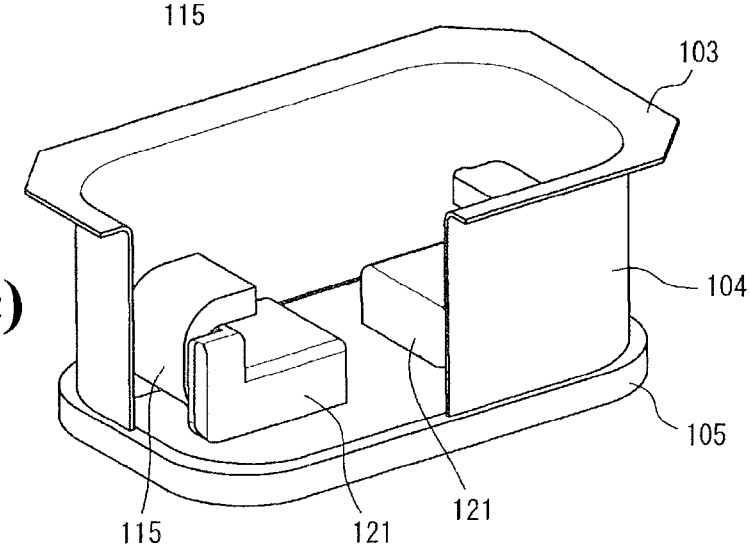

Actually, with the contact housing case 102 after the fixed contacts 111 and 112 have been attached in a condition wherein the fixed contact support insulating substrate 105 is on the lower side, the insulating cover 121 is inserted from an upper aperture portion between the fixed contacts 111 and 112 in a condition vertically the reverse of that in FIGS. 3(*a*) to 3(*c*), as shown in FIG. 4(*a*).

Next, in a condition in which the fitting portion 125 is in contact with the fixed contact support insulating substrate 105, as shown in FIG. 4(*b*), the fitting portion 125 is engaged with and fixed to the small diameter portion 114*b* of the support conductor portion 114 of the fixed contacts 111 and 112 by pushing the insulating cover 121 to the outer side, as shown in FIG. 4(*c*).

By mounting the insulating cover 121 on the C-shaped portion 115 of the fixed contacts 111 and 112 in this way, only the upper surface side of the lower plate portion 118 of the inner peripheral surface of the C-shaped portion 115 is exposed, and is taken to be the contact portion 118*a*.

Further, the movable contact 130 is disposed in such a way that both end portions are disposed in the C-shaped portion 115 of the fixed contacts 111 and 112. The movable contact 130 is supported by a connecting shaft 131 fixed to a movable plunger 215 of the electromagnet unit 200, to be described hereafter. The movable contact 130 is such that, as shown in FIG. 1, a depressed portion 132 is formed, in which a central portion in the vicinity of the connecting shaft 131 protrudes downward, and a through hole 133 in which the connecting shaft 131 is inserted is formed in the depressed portion 132.

A flange portion 131*a* protruding outward is formed on the upper end of the connecting shaft 131. The connecting shaft 131 is inserted from the lower end side into a contact spring 134, then inserted into the through hole 133 of the movable contact 130, bringing the upper end of the contact spring 134 into contact with the flange portion 131*a*, and the moving contact 130 is positioned using, for example, a C-ring 135 so as to obtain a predetermined urging force from the contact spring 134.

The movable contact 130, in a released condition, takes on a condition wherein the contact portions at either end and the contact portions 118*a* of the lower plate portions 118 of the C-shaped portions 115 of the fixed contacts 111 and 112 are separated from each other and maintaining a predetermined interval. Also, the movable contact 130 is set so that, in an engaged position, the contact portions at either end contact with the contact portions 118*a* of the lower plate portions 118 of the C-shaped portions 115 of the fixed contacts 111 and 112 at a predetermined contact pressure due to the contact spring 134.

Furthermore, an insulating cylinder 140 formed in a bottomed tubular form of a tubular portion 140*a* and a bottom plate portion 140*b* formed on the lower surface of the tubular portion 140*a* is disposed on the inner peripheral surface of the tubular body 104 of the contact housing case 102. The insulating cylinder 140 is made of, for example, a synthetic resin, and the tubular portion 140*a* and bottom plate portion 140*b* are formed integrally. Magnet housing cylinders 141 and 142 are formed integrally as magnet housing portions in positions on the insulating cylinder 140 facing the side surfaces of the movable contact 130. Arc extinguishing permanent magnets 143 and 144 are inserted into and fixed in the magnet housing cylinders 141 and 142.

Figure 5:
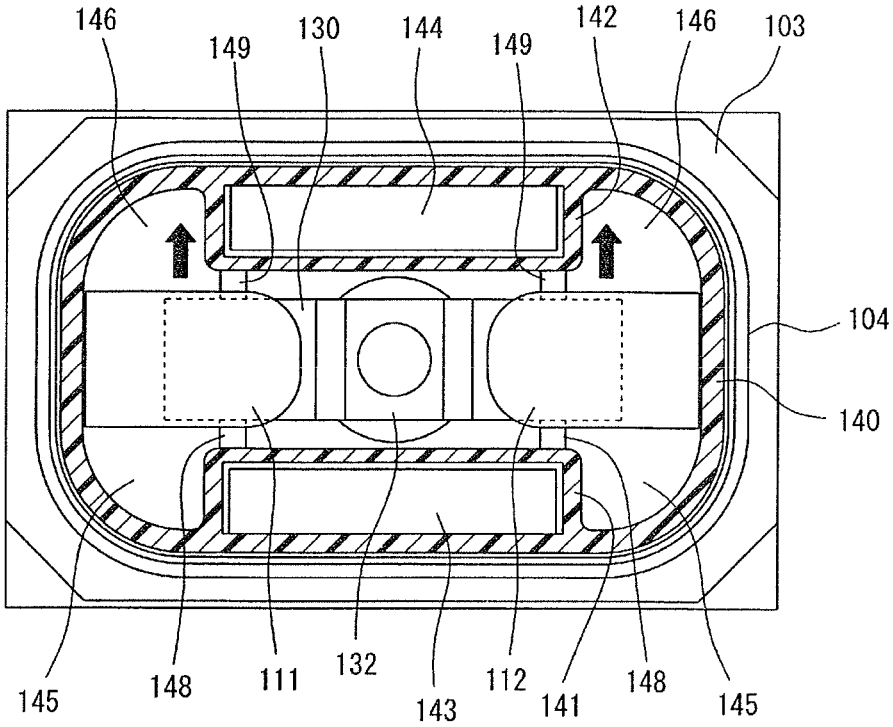
FIG. 5 is a sectional view along line A-A in FIG. 1.

The arc extinguishing permanent magnets 143 and 144 are magnetized in a thickness direction so that mutually opposing faces thereof are homopolar, for example, N-poles. Also, the arc extinguishing permanent magnets 143 and 144 are set so that both end portions in a left-right direction are slightly inward of positions in which the contact portions 118*a* of the fixed contacts 111 and 112 and the contact portions of the movable contact 130 are facing each other, as shown in FIG. 5. Further, arc extinguishing spaces 145 and 146 are formed on the outer sides in a left-right direction, that is, the longitudinal direction of the movable contact, of the magnet housing cylinders 141 and 142 respectively.

Also, movable contact guide members 148 and 149, which regulate the turning of the movable contact 130, are formed protruding, sliding against side edges of the magnet housing cylinders 141 and 142 toward either end of the movable contact 130.

Consequently, the insulating cylinder 140 has a function of positioning the arc extinguishing permanent magnets 143 and 144 using the magnet housing cylinders 141 and 142, a function of protecting the arc extinguishing permanent magnets 143 and 144 from an arc, an insulating function preventing the arc from affecting the metal tubular body 104, which increases external rigidity, and a function of regulating the turning of the movable contact 130.

Further, by disposing the arc extinguishing permanent magnets 143 and 144 on the inner peripheral surface side of the insulating cylinder 140 in this way, it is possible to bring the arc extinguishing permanent magnets 143 and 144 near to the movable contact 130. Because of this, as shown in FIG. 6(*a*), magnetic flux $\phi$ emanating from the N-pole sides of the two arc extinguishing permanent magnets 143 and 144 crosses portions in which the contact portions 118*a* of the fixed contacts 111 and 112 and the contact portions 130*a* of the movable contact 130 are facing in a left-right direction, from the inner side to the outer side, with a large flux density.

Figure 6A:
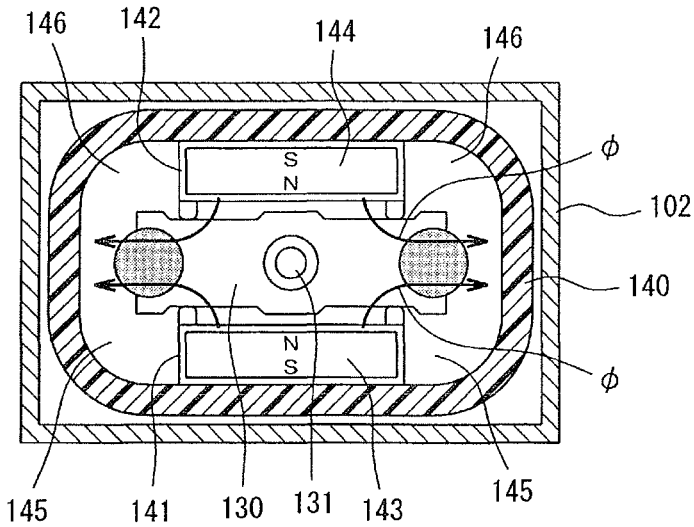
FIGS. 6(*a*)-6(*c*) are diagrams accompanying a description of arc extinguishing by an arc extinguishing permanent magnet according to the invention.
Figure 6B:
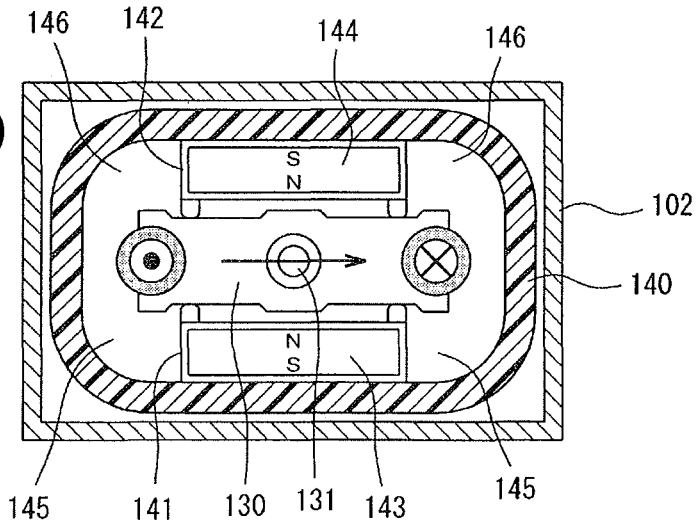
Figure 6C:
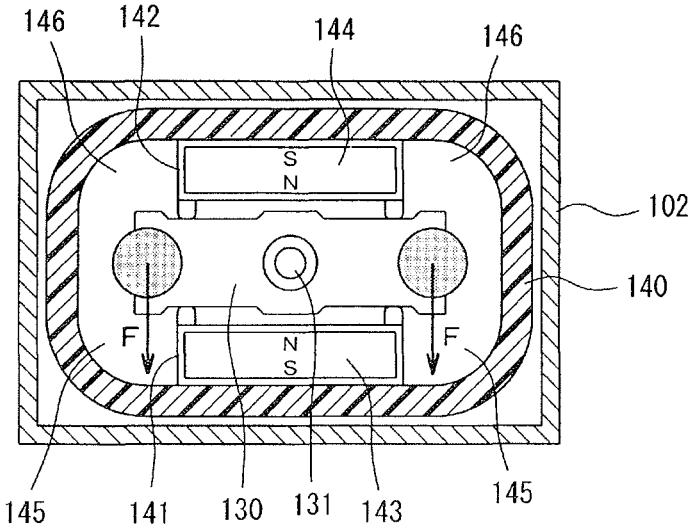

Consequently, assuming that the fixed contact 111 is connected to a current supply source and the fixed contact 112 is connected to a load side, the current direction in the engaged condition is such that the current flows from the fixed contact 111 through the movable contact 130 to the fixed contact 112, as shown in FIG. 6(*b*). Then, when changing from the engaged condition to the released condition by causing the movable contact 130 to move away upward from the fixed contacts 111 and 112, an arc is generated between the contact portions 118*a* of the fixed contacts 111 and 112 and the contact portions 130*a* of the movable contact 130.

The arc is extended to the arc extinguishing space 145 side on the arc extinguishing permanent magnet 143 side by the magnetic flux ϕ from the arc extinguishing permanent magnets 143 and 144. At this time, because the arc extinguishing spaces 145 and 146 are formed as widely as the thickness of the arc extinguishing permanent magnets 143 and 144, it is possible to obtain a long arc length, and thus possible to reliably extinguish the arc.

Figure 7A:
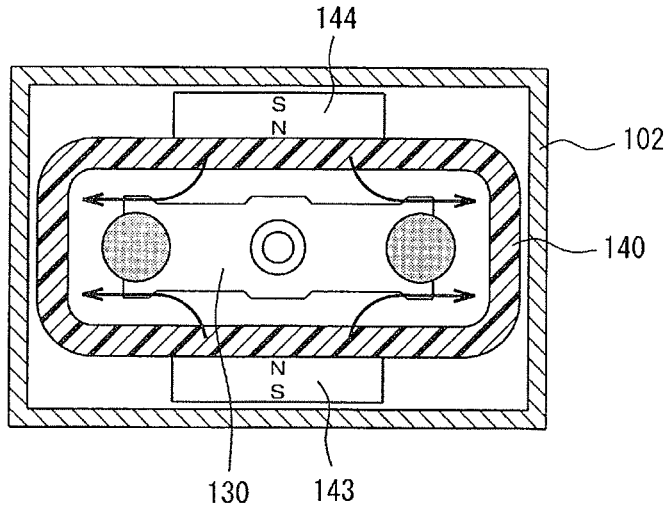
FIGS. 7(*a*)-7(*c*) are diagrams accompanying a description of arc extinguishing when the arc extinguishing permanent magnet is disposed on the outer side of an insulating case.
Figure 7B:
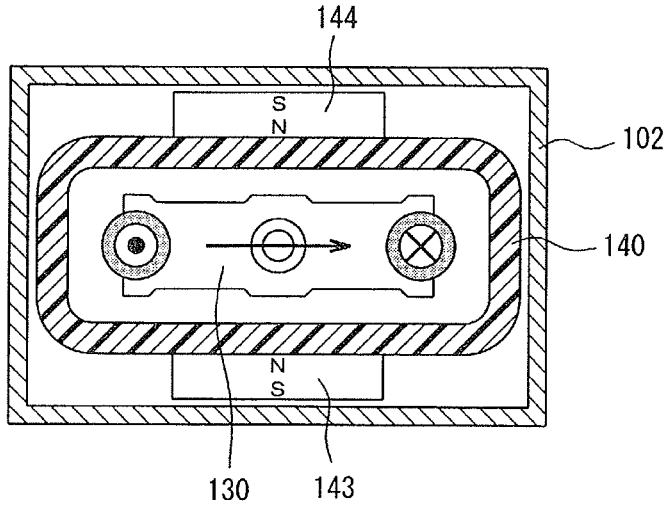
Figure 7C:
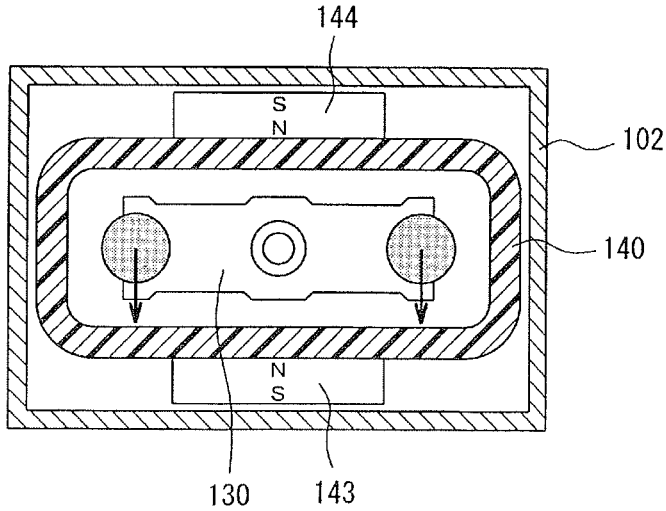

Incidentally, when the arc extinguishing permanent magnets 143 and 144 are disposed on the outer side of the insulating cylinder 140, as shown in FIGS. 7(*a*) to 7(*c*), there is an increase in the distance to the positions in which the contact portions 118*a* of the fixed contacts 111 and 112 and the contact portions 130*a* of the movable contact 130 are facing each other, and when the same permanent magnets as in this embodiment are applied, the density of the magnetic flux crossing the arc decreases.

Because of this, the Lorentz force acting on an arc generated when shifting from the engaged condition to the released condition decreases, and it is no longer possible to sufficiently extend the arc. In order to improve the arc extinguishing performance, it is necessary to increase the magnetization of the arc extinguishing permanent magnets 143 and 144. Moreover, in order to shorten the distance between the arc extinguishing permanent magnets 143 and 144 and the contact portions of the fixed contacts 111 and 112 and movable contact 130, it is necessary to reduce the depth in a front-back direction of the insulating cylinder 140, and there is a problem in that it is not possible to secure sufficient arc extinguishing space to extinguish the arc.

However, according to the heretofore described embodiment, the arc extinguishing permanent magnets 143 and 144 are disposed on the inner side of the insulating cylinder 140, meaning that the problems occurring when the arc extinguishing permanent magnets 143 and 144 are disposed on the outer side of the insulating cylinder 140 can all be solved.

The electromagnet unit 200, as shown in FIG. 1, has a magnetic yoke 201 of a flattened U-shape when seen from the side, and a cylindrical auxiliary yoke 203 is fixed in a central portion of a bottom plate portion 202 of the magnetic yoke 201. A spool 204 is disposed on the outer side of the cylindrical auxiliary yoke 203.

The spool 204 is configured of a central cylinder portion 205 in which the cylindrical auxiliary yoke 203 is inserted, a lower flange portion 206 protruding outward in a radial direction from a lower end portion of the central cylinder portion 205, and an upper flange portion 207 protruding outward in a radial direction from slightly below the upper end of the central cylinder portion 205. Further, an exciting coil 208 is mounted wound in a housing space configured of the central cylinder portion 205, lower flange portion 206, and upper flange portion 207.

Further, an upper magnetic yoke 210 is fixed between upper ends forming an opened end of the magnetic yoke 201. A through hole 210*a* facing the central cylinder portion 205 of the spool 204 is formed in a central portion of the upper magnetic yoke 210.

Further, the movable plunger 215, in which is disposed a return spring 214 between a bottom portion and the bottom plate portion 202 of the magnetic yoke 201, is disposed in the central cylinder portion 205 of the spool 204 so as to be able to slide up and down. A peripheral flange portion 216 protruding outward in a radial direction is formed on the movable plunger 215, on an upper end portion protruding upward from the upper magnetic yoke 210.

Also, a permanent magnet 220 formed in a ring-form, whose external form is, for example, rectangular and which has a circular central aperture 221, is fixed to the upper surface of the upper magnetic yoke 210 so as to enclose the peripheral flange portion 216 of the movable plunger 215. The permanent magnet 220 is magnetized in an up-down direction, that is, a thickness direction, so that the upper end side is, for example, an N-pole while the lower end side is an S-pole. Taking the form of the central aperture 221 of the permanent magnet 220 to be a form tailored to the form of the peripheral flange portion 216, the form of the outer peripheral surface can be any form, such as circular or rectangular.

Further, an auxiliary yoke 225 of the same external form as the permanent magnet 220, and having a through hole 224 with an inner diameter smaller than the outer diameter of the peripheral flange portion 216 of the movable plunger 215, is fixed to the upper end surface of the permanent magnet 220. The peripheral flange portion 216 of the movable plunger 215 contacts with the lower surface of the auxiliary yoke 225.

Also, the connecting shaft 131 that supports the movable contact 130 is screwed to the upper end surface of the movable plunger 215.

Further, the movable plunger 215 is covered with a cap 230 formed in a bottomed tubular form made of a non-magnetic body, and a flange portion 231 formed extending outward in a radial direction on an opened end of the cap 230 is seal joined to the lower surface of the upper magnetic yoke 210. By so doing, a hermetic receptacle, wherein the contact housing case 102 and cap 230 are in communication via the through hole 210*a* of the upper magnetic yoke 210, is formed. Further, a gas such as hydrogen gas, nitrogen gas, a mixed gas of hydrogen and nitrogen, air, or $SF_6$ is encapsulated inside the hermetic receptacle formed by the contact housing case 102 and cap 230.

Next, a description will be given of an operation of the heretofore described embodiment.

For now, it is assumed that the fixed contact 111 is connected to, for example, a power supply source that supplies a large current, while the fixed contact 112 is connected to a load.

In this condition, the exciting coil 208 in the electromagnet unit 200 is in a non-excited state, and there exists a released condition wherein no exciting force causing the movable plunger 215 to descend is being generated in the electromagnet unit 200. In this released condition, the movable plunger 215 is urged in an upward direction away from the upper magnetic yoke 210 by the return spring 214. Simultaneously with this, an attracting force caused by the permanent magnet 220 acts on the auxiliary yoke 225, and the peripheral flange portion 216 of the movable plunger 215 is suctioned. Because of this, the upper surface of the peripheral flange portion 216 of the movable plunger 215 contacts with the lower surface of the auxiliary yoke 225.

Consequently, the contact portions 130*a* of the movable contact 130 of the contact mechanism 101 connected to the movable plunger 215 via the connecting shaft 131 are separated by a predetermined distance upward from the contact portions 118*a* of the fixed contacts 111 and 112. Because of this, the current path between the fixed contacts 111 and 112 is in an interrupted condition, and the contact mechanism 101 is in a condition wherein the contacts are opened.

In this way, as the urging force of the return spring 214 and the attracting force of the ring-form permanent magnet 220 both act on the movable plunger 215 in the released condition, there is no unplanned downward movement of the movable plunger 215 due to external vibration, shock, or the like, and it is thus possible to reliably prevent malfunction.

On the exciting coil 208 of the electromagnet unit 200 being excited in the released condition, an exciting force is generated in the electromagnet unit 200, and the movable plunger 215 is pressed downward against the urging force of the return spring 214 and the attracting force of the ring-form permanent magnet 220.

Further, the descent of the movable plunger 215 is stopped by the lower surface of the peripheral flange portion 216 contacting with the upper surface of the upper magnetic yoke 210.

By the movable plunger 215 descending in this way, the movable contact 130 connected to the movable plunger 215 via the connecting shaft 131 also descends, and the contact portions 130*a* of the movable contact 130 contacts with the contact portions 118*a* of the fixed contacts 111 and 112 with the contact pressure of the contact spring 134.

Because of this, there exists a closed contact condition wherein the large current of the external power supply source is supplied via the fixed contact 111, movable contact 130, and fixed contact 112 to the load.

At this time, an electromagnetic repulsion force is generated between the fixed contacts 111 and 112 and the movable contact 130 in a direction such as to cause the contacts of the movable contact 130 to open.

However, as the fixed contacts 111 and 112 are such that the C-shaped portion 115 is formed of the upper plate portion 116, intermediate plate portion 117, and lower plate portion 118, as shown in FIG. 1, the current in the upper plate portion 116 and lower plate portion 118 and the current in the opposing movable contact 130 flow in opposite directions. Because of this, from the relationship between a magnetic field formed by the lower plate portions 118 of the fixed contacts 111 and 112 and the current flowing through the movable contact 130, it is possible, in accordance with Fleming's left-hand rule, to generate a Lorentz force that presses the movable contact 130 against the contact portions 118*a* of the fixed contacts 111 and 112.

Because of this Lorentz force, it is possible to oppose the electromagnetic repulsion force generated in the contact opening direction between the contact portions 118*a* of the fixed contacts 111 and 112 and the contact portions 130*a* of the movable contact 130, and thus possible to reliably prevent the contact portions 130*a* of the movable contact 130 from opening. Because of this, it is possible to reduce the pressing force of the contact spring 134 supporting the movable contact 130, and also possible to reduce thrust generated in the exciting coil 208 in response to the pressing force, and it is thus possible to reduce the size of the overall configuration of the electromagnetic contactor.

When interrupting the supply of current to the load in the closed contact condition of the contact mechanism 101, the exciting of the exciting coil 208 of the electromagnet unit 200 is stopped.

By so doing, the exciting force causing the movable plunger 215 to move downward in the electromagnet unit 200 stops, the movable plunger 215 is raised by the urging force of the return spring 214, and the attracting force of the ring-form permanent magnet 220 increases as the peripheral flange portion 216 nears the auxiliary yoke 225.

By the movable plunger 215 rising, the movable contact 130 connected via the connecting shaft 131 rises. As a result of this, the movable contact 130 is in contact with the fixed contacts 111 and 112 for as long as contact pressure is applied by the contact spring 134. Subsequently, there starts an opened contact condition, wherein the movable contact 130 moves upward away from the fixed contacts 111 and 112 at the point at which the contact pressure of the contact spring 134 stops.

On the opened contact condition starting, an arc is generated between the contact portions 118*a* of the fixed contacts 111 and 112 and the contact portions 130*a* of the movable contact 130, and the condition in which current is conducted is continued due to the arc. At this time, as the insulating cover 121 is mounted covering the upper plate portion 116 and intermediate plate portion 117 of the C-shaped portion 115 of the fixed contacts 111 and 112, it is possible to cause the arc to be generated only between the contact portions 118*a* of the fixed contacts 111 and 112 and the contact portions 130*a* of the movable contact 130. Because of this, it is possible to stabilize the arc generation condition, and thus possible to improve arc extinguishing performance.

At this time, as the opposing magnetic pole faces of the arc extinguishing permanent magnets 143 and 144 are N-poles, and the outer sides thereof are S-poles, magnetic flux emanating from the N-poles, seen in plan view as shown in FIG. 6(*a*), crosses an arc generation portion of a portion in which the contact portion 118*a* of the fixed contact 111 and the contact portion 130*a* of the movable contact 130 are facing each other, from the inner side to the outer side in the longitudinal direction of the movable contact 130, and reaches the S-pole, whereby a magnetic field is formed. In the same way, the magnetic flux crosses an arc generation portion of the contact portion 118*a* of the fixed contact 112 and the contact portion 130*a* of the movable contact 130, from the inner side to the outer side in the longitudinal direction of the movable contact 130, and reaches the S-pole, whereby a magnetic field is formed.

Consequently, the magnetic fluxes of the arc extinguishing magnets 143 and 144 both cross between the contact portion 118*a* of the fixed contact 111 and the contact portion 130*a* of the movable contact 130 and between the contact portion 118*a* of the fixed contact 112 and the contact portion 130*a* of the movable contact 130, in mutually opposite directions in the longitudinal direction of the movable contact 130.

Because of this, a current I flows from the fixed contact 111 side to the movable contact 130 side between the contact portion 118*a* of the fixed contact 111 and the contact portion 130*a* of the movable contact 130, and the orientation of the magnetic flux $\phi$ is in a direction from the inner side toward the outer side, as shown in FIG. 6(*b*). Because of this, in accordance with Fleming's left-hand rule, a large Lorentz force F acts toward the arc extinguishing space 145, perpendicular to the longitudinal direction of the movable contact 130 and perpendicular to the switching direction of the contact portion 118*a* of the fixed contact 111 and the movable contact 130, as shown in FIG. 6(*c*).

Due to the Lorentz force F, an arc generated between the contact portion 118*a* of the fixed contact 111 and the contact portion 130*a* of the movable contact 130 is greatly extended so as to pass from the side surface of the contact portion 118*a* of the fixed contact 111 through the inside of the arc extinguishing space 145, reaching the upper surface side of the movable contact 130, and is extinguished.

Also, at the lower side and upper side of the arc extinguishing space 145, magnetic flux inclines to the lower side and upper side with respect to the orientation of the magnetic flux between the contact portion 118*a* of the fixed contact 111 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, the current I flows from the movable contact 130 side to the fixed contact 112 side between the contact portion 118*a* of the fixed contact 112 and the movable contact 130, and the orientation of the magnetic flux ϕ is in a rightward direction from the inner side toward the outer side, as shown in FIG. 6(*b*). Because of this, in accordance with Fleming's left-hand rule, a large Lorentz force F acts toward the arc extinguishing space 145, perpendicular to the longitudinal direction of the movable contact 130 and perpendicular to the switching direction of the contact portion 118*a* of the fixed contact 112 and the movable contact 130.

Due to the Lorentz force F, an arc generated between the contact portion 118*a* of the fixed contact 112 and the movable contact 130 is greatly extended so as to pass from the upper surface side of the movable contact 130 through the inside of the arc extinguishing space 145, reaching the side surface side of the fixed contact 112, and is extinguished.

Also, at the lower side and upper side of the arc extinguishing space 145, as heretofore described, magnetic flux inclines to the lower side and upper side with respect to the orientation of the magnetic flux between the contact portion 118*a* of the fixed contact 112 and the contact portion 130*a* of the movable contact 130. Because of this, the arc extended to the arc extinguishing space 145 is further extended by the inclined magnetic flux in the direction of the corner of the arc extinguishing space 145, it is possible to increase the arc length, and thus possible to obtain good interruption performance.

Meanwhile, in the engaged condition of the electromagnetic contactor 10, when adopting a released condition in a condition wherein a regenerative current flows from the load side to the direct current power source side, the direction of current in FIG. 6(*b*) is reversed, meaning that the Lorentz force F acts on the arc extinguishing space 146 side, and excepting that the arc is extended to the arc extinguishing space 146 side, the same arc extinguishing function is fulfilled.

At this time, because the arc extinguishing permanent magnets 143 and 144 are disposed in the magnet housing cylinders 141 and 142 formed in the insulating cylinder 140, the arc does not directly contact with the arc extinguishing permanent magnets 143 and 144. Because of this, it is possible to stably maintain the magnetic characteristics of the arc extinguishing permanent magnets 143 and 144, and thus possible to stabilize interruption performance.

Also, as it is possible to cover and insulate the inner peripheral surface of the metal tubular body 104 with the insulating cylinder 140, there is no short circuiting of the arc when the current is interrupted, and it is thus possible to reliably carry out current interruption.

Furthermore, as it is possible to carry out the insulating function, the function of positioning the arc extinguishing permanent magnets 143 and 144, the function of protecting the arc extinguishing permanent magnets 143 and 144 from the arc, and the insulating function preventing the arc from reaching the external metal tubular body 104 with the one insulating cylinder 140, it is possible to reduce manufacturing cost.

Also, as it is possible to increase the distance between the side edges of the movable contact 130 and the inner peripheral surface of the insulating cylinder 140 by the thickness of the arc extinguishing permanent magnets 143 and 144, it is possible to provide sufficient arc extinguishing spaces 145 and 146, and thus possible to reliably carry out arc extinguishing.

Furthermore, as the movable contact guide members 148 and 149 that slide against a side edge of the movable contact are formed protruding on the permanent magnet housing cylinders 141 and 142 housing the arc extinguishing permanent magnets 143 and 144 in positions opposing the movable contact 130, it is possible to reliably prevent turning of the movable contact 130.

Figure 8:
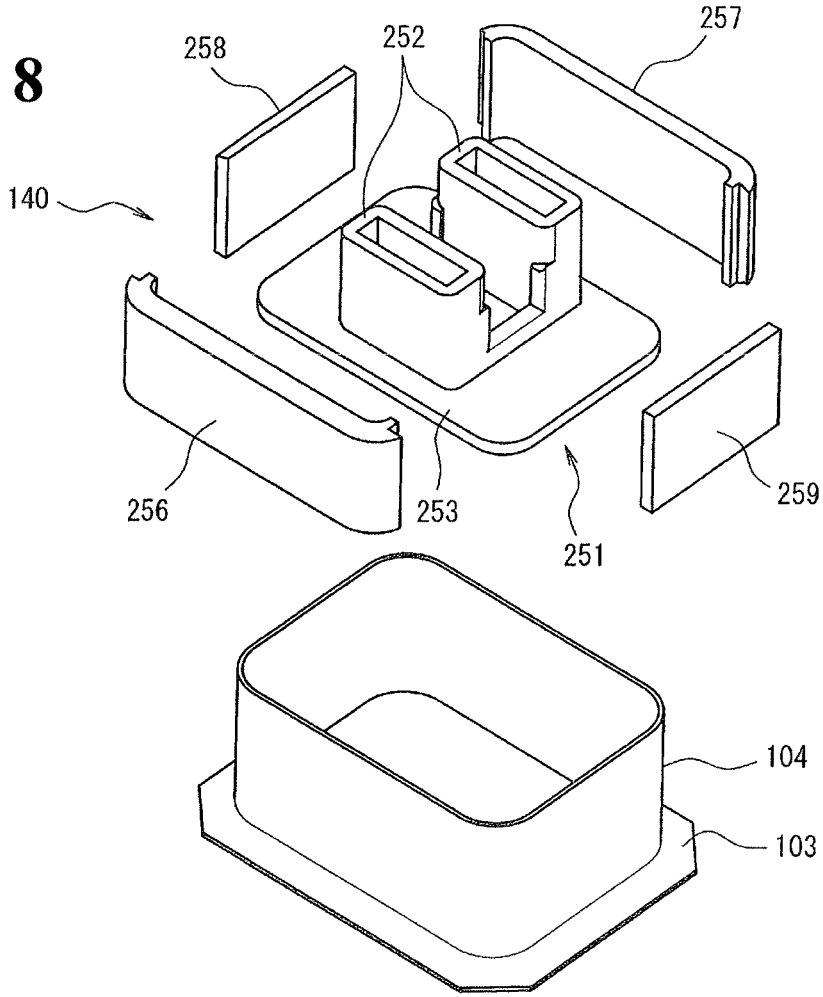
FIG. 8 is a perspective view showing another example of an insulating cylinder configuring the contact housing case.

In the heretofore described embodiment, a description has been given of a case wherein the insulating cylinder 140 is configured by the tubular portion 140*a* and bottom plate portion 140*b* being formed integrally but, not being limited to this, the insulating cylinder 140 may be formed by disposing an assembly of four side plate portions 256 to 259 configuring side walls on front and back and left and right portions of a bottom plate portion 253 on which is formed a magnet housing portion 252 of a base member 251, and connecting the side plate portions 256 to 259, as shown in FIG. 8. In this case, as the side wall portion is divided into the four side plate portions 256 to 259, manufacturing is easy compared to the case in which the whole is formed integrally. Furthermore, a tubular body wherein the four side plate portions 256 to 259 are integrated may also be formed.

Also, in the heretofore described embodiment, a description has been given of a case wherein the opposing magnetic pole faces of the arc extinguishing permanent magnets 143 and 144 are N-poles but, not being limited to this, it is also possible to obtain the same advantages as in the heretofore described embodiment when arranging so that the opposing magnetic pole faces of the arc extinguishing permanent magnets 143 and 144 are S-poles, with the exception that the direction in which the magnetic flux crosses the arc and the direction of the Lorentz force are reversed.

Figure 9A:
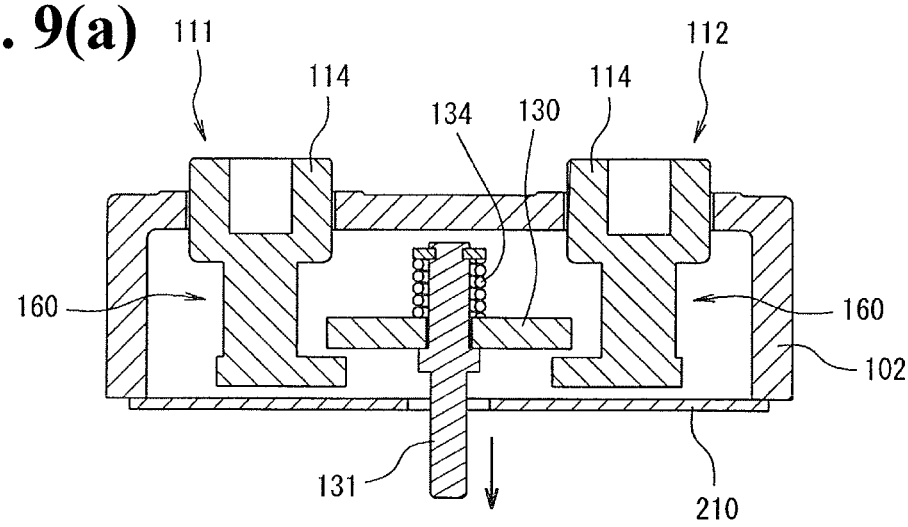
FIGS. 9(*a*)-9(*b*) are diagrams showing another example of a contact mechanism, wherein FIG. 9(*a*) is a sectional view and FIG. 9(*b*) is a perspective view.
Figure 9B:
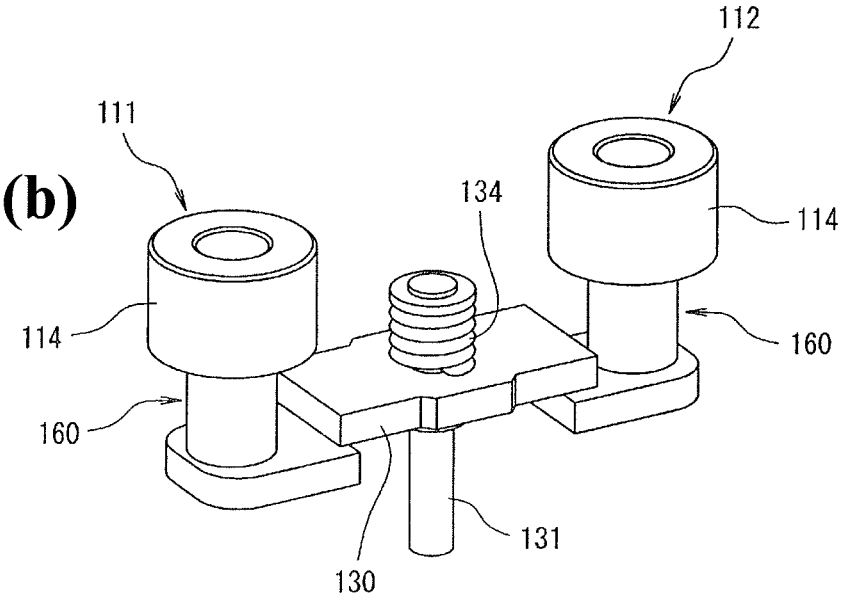

Also, in the heretofore described embodiment, a description has been given of a case wherein the C-shaped portion 115 is formed in the fixed contacts 111 and 112 but, not being limited to this, an L-shaped portion 160, of a form such that the upper plate portion 116 of the C-shaped portion 115 is omitted, may be connected to the support conductor portion 114, as shown in FIGS. 9(*a*) and (*b*).

In this case too, in the closed contact condition wherein the movable contact 130 contacts with the fixed contacts 111 and 112, it is possible to cause magnetic flux generated by the current flowing through a vertical plate portion of the L-shaped portion 160 to act on portions in which the fixed contacts 111 and 112 and the movable contact 130 are in contact. Because of this, it is possible to increase the magnetic flux density in the portions in which the fixed contacts 111 and 112 and the movable contact 130 are in contact, generating a Lorentz force that opposes the electromagnetic repulsion force.

Figure 10A:
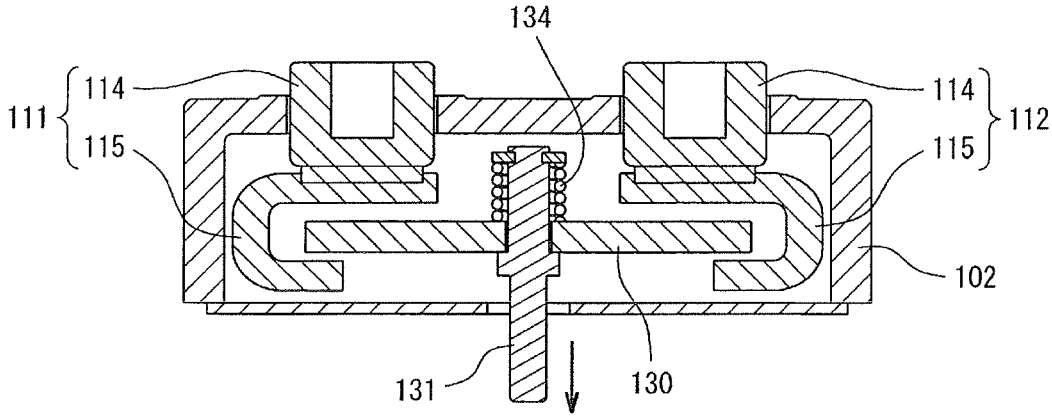
FIGS. 10(*a*)-10(*b*) are diagrams showing another example of a movable contact of a contact mechanism, wherein FIG. 10(*a*) is a sectional view and FIG. 10(*b*) is a perspective view.
Figure 10B:
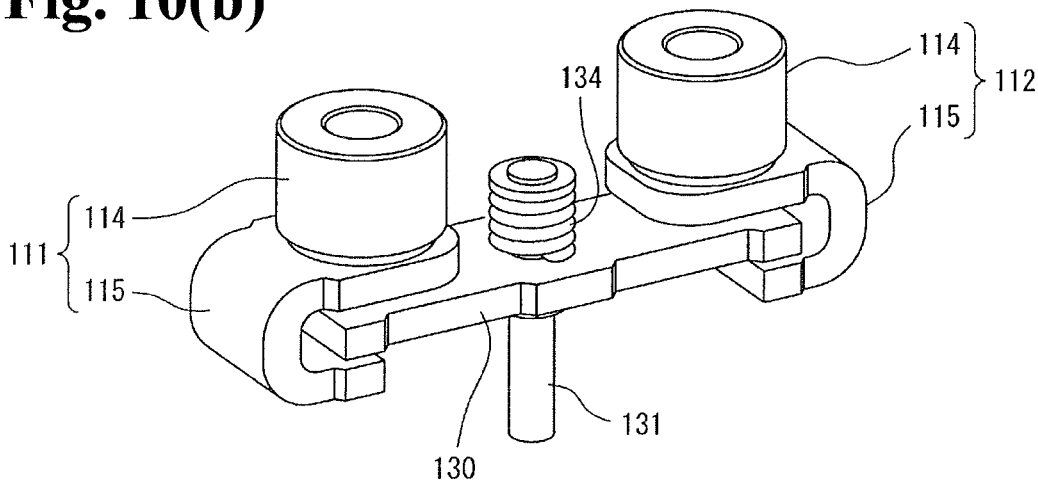

Also, in the heretofore described embodiment, a description has been given of a case wherein the movable contact 130 has the depressed portion 132 in a central portion thereof but, not being limited to this, the depressed portion 132 may be omitted, forming a flat plate, as shown in FIGS. 10(*a*) and 10(*b*).

Furthermore, the case wherein the movable contact 130 is disposed to be capable of contacting to and separating from the fixed contacts 111 and 112 from above is explained, but the invention is not limited to the structure, and the movable contact 130 may be disposed so as to be capable of contacting to and separating from the fixed contacts 111 and 112 from the lower side.

Also, in the first and second embodiment heretofore described, a description has been given of a case wherein the connecting shaft 131 is screwed to the movable plunger 215, but the movable plunger 215 and connecting shaft 131 may also be formed integrally.

Also, a description has been given of a case wherein the connection of the connecting shaft 131 and movable contact 130 is such that the flange portion 131*a* is formed on the leading end portion of the connecting shaft 131, and the lower end of the movable contact 130 is fixed with a C-ring after the connecting shaft 131 is inserted into the contact spring 134 and movable contact 130, but the structure is not limited to this. That is, a positioning large diameter portion may be formed protruding in a radial direction in the C-ring position of the connecting shaft 131, the contact spring 134 disposed after the movable contact 130 contacts with the large diameter portion, and the upper end of the contact spring 134 fixed with the C-ring.

Also, the configuration of the electromagnet unit 200 not being limited to the heretofore described configuration, an electromagnet unit of any configuration can be applied.

Also, in the heretofore described embodiment, a description has been given of a case wherein a hermetic receptacle is configured of the contact housing case 102 and cap 230, and gas is encapsulated inside the hermetic receptacle but, the structure is not limited to this, and the gas encapsulation may be omitted when the interrupted current is small.

INDUSTRIAL APPLICABILITY

According to the invention, it is possible to provide an electromagnetic contactor including a function of positioning a permanent magnet for arc extinguishing, a function protecting from an arc, and necessary insulating functions, thereby enabling a reduction in size while ensuring a sufficient arc extinguishing function.

What is claimed is:

1. An electromagnetic contactor, comprising:

a contact device having a contact housing case, a pair of fixed contacts and a movable contact contacting to and separating from the pair of fixed contacts, the contact housing case housing the pair of fixed contacts and the movable contact, and an insulating cylinder in a bottomed tubular shape disposed in an inner peripheral surface of the contact housing case to enclose the pair of fixed contacts and the movable contact, the insulating cylinder including a pair of arc extinguishing permanent magnets for extinguishing an arc generated between the pair of fixed contacts and the movable contact, a pair of magnet housing portions where the pair of arc extinguishing permanent magnets is inserted, each projecting inwardly to face a side surface portion of the movable contact, for protecting the pair of arc extinguishing permanent magnets from the arc formed on an inner peripheral surface of the insulating cylinder, and two arc extinguishing spaces respectively arranged adjacent to outer side portions of each of the pair of magnet housing portions and facing the side surface portion of the movable contact, wherein the insulating cylinder comprises an insulating base member in a rectangular shape viewed from a plan view, a front plate portion and a rear plate portion, each extending along a long side of the insulating base member, a pair of side plate portions extending along short sides of the insulating base member, and a pair of connection members connecting side edges of the pair of side plate portions and the front and rear plate portions along the outer side portions of the pair of the magnet housing portions, and the pair of magnet housing portions respectively projects inwardly from the front plate portion and the rear plate portion to face the side surface portion of the movable contact.

2. An electromagnetic contactor according to claim 1, wherein the pair of magnet housing portions is arranged to face a center portion of the movable contact relative to a longitudinal direction of the movable contact.

3. An electromagnetic contactor according to claim 1, wherein the insulating cylinder includes a movable contact guide member for regulating movement of the movable contact, the movable contact guide member extending in a direction perpendicular to a longitudinal direction of the movable contact between the pair of magnet housing portions.

4. An electromagnetic contactor, comprising:

a contact device having a contact housing case, a pair of fixed contacts and a movable contact contacting to and separating from the pair of fixed contacts, the contact housing case housing the pair of fixed contacts and the movable contact, and an insulating cylinder in a bottomed tubular shape disposed in an inner peripheral surface of the contact housing case to enclose the pair of fixed contacts and the movable contact, the insulating cylinder including a pair of arc extinguishing permanent magnets for extinguishing an arc generated between the pair of fixed contacts and the movable contact, a pair of magnet housing portions where the pair of arc extinguishing permanent magnets is inserted, each projecting inwardly to face a side surface portion of the movable contact, for protecting the pair of arc extinguishing permanent magnets from the arc formed on an inner peripheral surface of the insulating cylinder, and two arc extinguishing spaces respectively arranged adjacent to outer side portions of each of the pair of magnet housing portions and facing the side surface portion of the movable contact, wherein the pair of fixed contacts includes a pair of C-shaped portions, each having an upper plate portion extending outwardly in a longitudinal direction of the movable contact, an intermediate plate portion extending downwardly from one end portion of the upper plate portion and a lower plate portion extending inwardly from a lower end portion of the intermediate plate portion in the longitudinal direction of the movable contact; and the movable contact contacts to and separates from one end portion of the lower end portion.

5. An electromagnetic contactor according to claim 4, wherein the insulating cylinder in the bottomed tubular shape is integrally formed.

6. An electromagnetic contactor according to claim 4, wherein the insulating cylinder comprises an insulating base member formed at a base portion thereof and an insulating tubular portion mounted on an upper surface of the insulating base member.

7. An electromagnetic contactor according to claim 4, wherein the pair of fixed contacts further includes a pair of insulating covers for regulating arc generation, each having an L-shaped plated portion to cover inner surfaces of the upper plate portion and the intermediate plate portion.

* * * * *

UNITED STATES PATENT AND TRADEMARK OFFICE

CERTIFICATE OF CORRECTION

PATENT NO. : 8,749,331 B2
APPLICATION NO. : 13/878933
DATED : June 10, 2014
INVENTOR(S) : Osamu Kashimura et al.

It is certified that error appears in the above-identified patent and that said Letters Patent is hereby corrected as shown below:

In the Specification

Please change column 13, lines 31 to 32, from "… a function protecting from…" to -- a function of protecting from --.

Signed and Sealed this
Twenty-fourth Day of February, 2015

Michelle K. Lee

Michelle K. Lee
*Deputy Director of the United States Patent and Trademark Office*